United States Patent [19]

Muhs, Jr. et al.

[11] Patent Number: 4,499,474

[45] Date of Patent: Feb. 12, 1985

[54] SLOT ANTENNA WITH FACE MOUNTED BAFFLE

[76] Inventors: Harvey P. Muhs, Jr., 10331 Shirley Ave., Northridge, Calif. 91326; Charles K. Watson, 653-33rd St., Manhatten Beach, Calif. 90266

[21] Appl. No.: 363,264

[22] Filed: Mar. 29, 1982

[51] Int. Cl.[3] ..... H01Q 13/10

[52] U.S. Cl. ..... 343/771

[58] Field of Search ..... 343/768, 770, 771, 841, 343/16 M

[56] References Cited

U.S. PATENT DOCUMENTS

| | | | |
|---|---|---|---|
| 3,067,421 | 12/1962 | O'Nihns et al. | 343/771 |
| 3,681,770 | 8/1972 | Alford | 343/841 |
| 4,376,281 | 3/1983 | Smith | 343/768 |

*Primary Examiner*—Eli Lieberman

*Attorney, Agent, or Firm*—Sanford Astor

[57] ABSTRACT

An improved planar slot array antenna comprising a conducting fence or baffle interposed between the two halves of the antenna in a plane perpendicular to the flat plate or E-field.

4 Claims, 5 Drawing Figures

1
2
3
4
6
10
12
14
18
20

0
10
20
30
40
RELATIVE POWER (dB)
60°
30°
0°
30°
60°

SLOT ANTENNA WITH FACE MOUNTED BAFFLE

BACKGROUND

Planar slot array antennas are well known in the art and generally include radiating slot apertures cut in the broad walls of several contiguous waveguides or waveguide cavities that form the aperture, and some means of distributing a radio frequency signal in such a way as to excite each radiating slot with the proper electric field to produce the desired farfield radiation pattern. Planar slot arrays have found wide usage in airborne radar and missile guidance system applications because of their compact size, high efficiency, and economical construction.

When an array is divided functionally into four quadrants, the four signals received can be processed by a passive microwave device known as a "comparator" to provide three new signals, referred to as sum, azimuth difference, and elevation difference. The three signals are generated simultaneously and can act upon a single received radar pulse to provide tracking information—hence the term "monopulse" tracking system. Such tracking systems are widely preferred over antecedent lobing techniques because of their relative immunity to jamming (electronic countermeasure techniques used by an adversary to disrupt the radar system's tracking capability.)

Certain properties of the monopulse antenna are crucial to the operation of the radar system. The detection range of a radar system is proportional to the square root of the antenna gain. In contrast, it is only proportional to the fourth root of the transmitted power or receiver noise figure. Antenna gain can be defined as the antenna efficiency times the maximum theoretical gain that can be achieved for a given sized aperture. The antenna efficiency is a number less than one. Sidelobe level is a measure of the field strength in a given direction relative to that at the peak of the main beam. Low sidelobes reduce unwanted ground clutter or jamming signals entering the antenna from directions other than the main beam.

Properties of the difference pattern are important to the tracking operation. The difference pattern peak level should not be too far below that of the sum peak or the tracking range will be degraded. The null of the difference pattern should be deep and pointed in a direction parallel to the antenna boresight to prevent false error information. As with the sum beam, sidelobe levels must be low. Sensitivity is defined as ratio of difference pattern level to sum pattern level at a specified angle from boresight. Tracking loop gain is adjusted on the basis of this parameter, therefore it is important that the sensitivity be constant over the frequency band of the antenna if accurate radar tracking or missile guidance is to take place.

One problem that has plagued the users and designers of small monopulse tracking arrays is that sum and difference patterns cannot be optimized simultaneously without resorting to slot excitation or "feeding" techniques that are prohibitively complex. Consequently, difference pattern sidelobes are generally marginal in performance. Even more serious is the drawback that monopulse sensitivity variations over a frequency band are excessive; the cause of this problem has previously been poorly understood. An invention which can help to substantially alleviate these problems will be described.

The best known prior art consists of an array of slots in the conducting surface formed by the broad walls of several contiguous waveguides. Each quarter or quadrant of the antenna is connected to a monopulse comparator to provide sum, azimuth difference, and elevation difference signals.

The monopulse comparator consists of 4 sum and difference circuits, sometimes referred to as "hybrid tees" or "magic tees", connected by transmission lines in such a way as to provide the sum of the four antenna quadrant signals $A+B+C+D$, the elevation difference signal $(A+B)-(C+D)$ and the azimuth difference signal $(A+C)-(B+D)$.

In order to provide low antenna sidelobes for the sum beam, which is used for searching and tracking functions, the distribution of electric field over the aperture is lowest at the edge and highest towards the middle. The sharp discontinuity produced in the aperture field strength at the center of the aperture is generally known to produce high difference pattern sidelobes. The inventors have also found that this discontinuity produces other anomalous performance degradation including a further deterioration of difference pattern sidelobe levels that is not predicted by existing theory and serious fluctuations of the sensitivity and difference pattern peak levels over the operating frequency range of the antenna. This behavior is largely due to changes in impedance of the individual radiator in the presence of other radiators, i.e., mutual coupling.

To improve difference pattern peak levels and sidelobe levels others have devised complex feed systems that produce independent sum and difference excitations so that ideal sum and difference pattern excitations can be simultaneously achieved. Included in this category are ladder feeds and dual corporate feeds. These feed systems suffer from the drawback that their size, weight, cost and complexity render them unattractive for the majority of applications. For applications with extreme weight and volume restrictions, such as missile seeker radars, antennas with these complex feed systems are totally unacceptable.

Other inventions, such as dipole augmented slot radiating elements (U.S. Pat. No. 3,594,806) produce a modest reduction in mutual coupling, relative to simple slot radiators; however, these augmented slots provide insufficient decoupling of the antenna quadrants and introduce increased costs and mechanical problems for manufacturing.

OBJECTS OF THE INVENTION

It is an object of the present invention to provide a method of improving a planar slot array antenna with vastly improved sensitivity.

Yet a further object of the invention is to provide a simple, inexpensive method to improve the sensitivity of planar slot array antennas.

Still a further object is to provide an improved slot array antenna with vastly improved sensitivity and low sidelobe interference.

These and other objects will be obvious from a description of the drawings and invention in which.

Figures 1, 2:
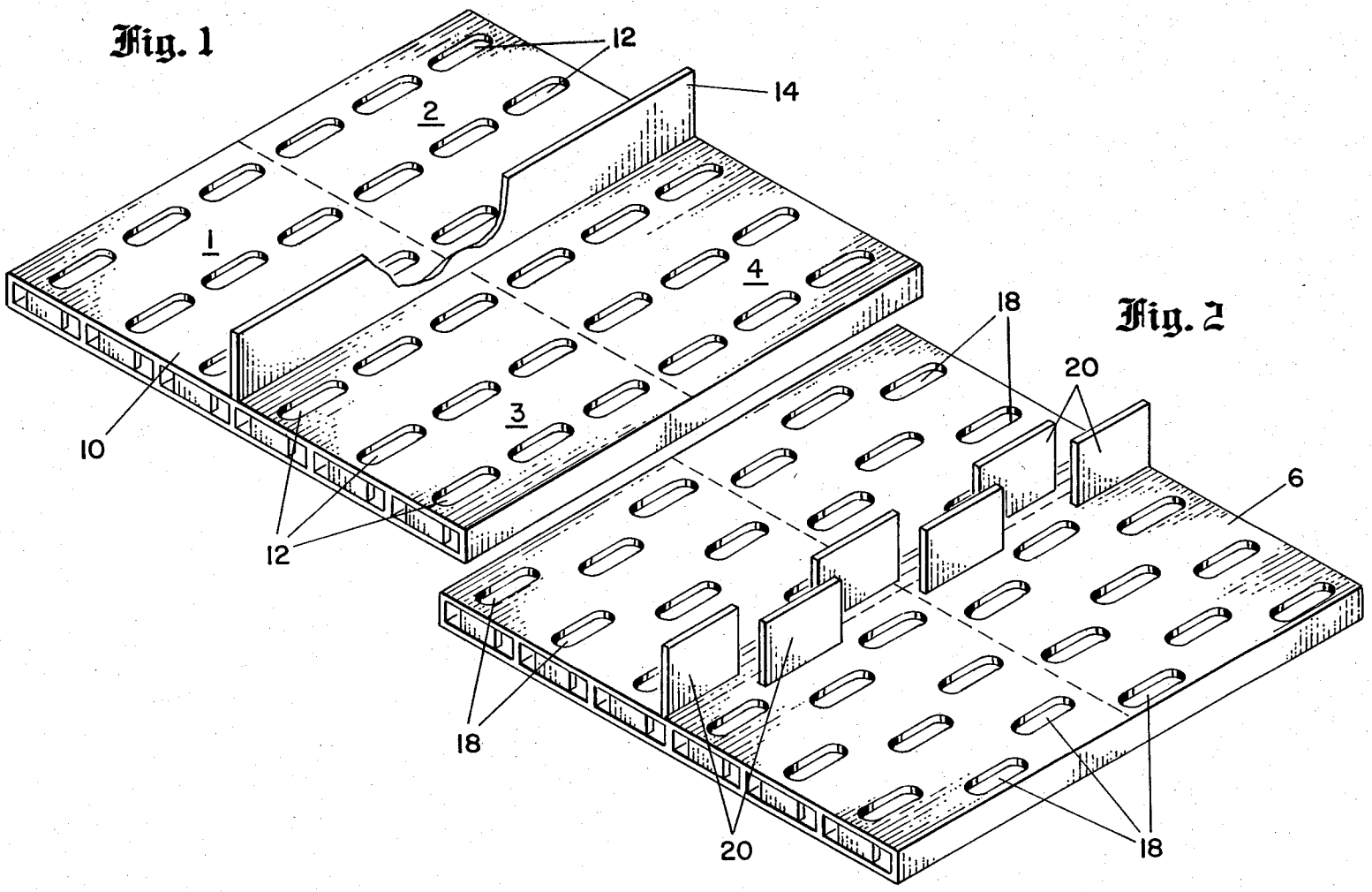
FIG. 1 is a perspective view partially broken away.
FIG. 2 is a perspective view of another embodiment.

Referring now to FIG. 1 there is shown the waveguide antenna of the present invention comprising a flat plate 10 containing radiating slots 12 arranged in a periodic lattice. The essential element of the invention is a conducting fence, or "baffle" 14, interposed between the functional halves of the antenna (A+B) and (C+D) that provide the signals for the elevation difference radiation pattern (A+B)−(C+D). This baffle 14 is positioned in a plane perpendicular to the flat plate 10. If the fence is sufficiently high the two functional halves of the aperture are significantly de-coupled. Less than one-half wavelength is sufficient for practical purposes.

If the radiating elements are slots as shown in FIG. 1, and if they are excited in-phase (sum signal), the presence of the baffle will have virtually no effect as a consequence of the imaging properties of a conducting plane positioned at the appropriate location.

The plate is considered arranged in four quadrants: A,B,C, and D shown as 1,2,3 and 4. When the when the upper, (A+B) and lower, (C+D) functional halves of the antenna are excited in anti-phase the elevation difference beam is produced (A+B)−(C+D). For conventional slot arrays, as in FIG. 1, the result is to alter the active admittance of the radiators near the antenna centerline in a significant way because of mutual coupling. The driving point, or active admittance of a slot in the $m^{th}$ row and $n^{th}$ column can be expressed as $$Y^{a}mn = Y\,mn + \sum_{\substack{ij \\ i=j}} \frac{V\,ij}{V\,mn}\, Y\,mnij$$

where $Y^{a}mn$=active driving point admittance of the slot in the $m^{th}$ row and $n^{th}$ column.

Y mn=self admittance, V ij=0 except for $$m = i$$
$$n = j.$$

Y mnij=mutual admittance between the $mn^{th}$ and $ij^{th}$ elements.

From this expression it is clear that the value of $Y^{a}mn$ is altered significantly when the sign of V ij is reversed for all ij in quadrants C and D, which condition represents the elevation difference pattern. The presence of a baffle, however, always presents an image that is in-phase when the baffle lies in a plane perpendicular to the E-field of the slot as shown in FIG. 1. Consequently, the driving point admittance of the slots remains nearly the same for either the sum or difference excitation, for a finite baffle. The slots 12 have longitudinal and transverse axes. The E-field is parallel to the transverse axes.

Note that a baffle is not required in the plane parallel to the E-field or vertical plane. This is a consequence of the fact that mutual coupling is much weaker between slots that are colinear, or nearly so, than it is for slots broadside to one another. Good performance is thus obtained for the difference beam in the plane parallel to the magnetic field without using baffles perpendicular to the magnetic field.

Note that the antenna is a reciprocal device; one can speak of its properties on transmission for purposes of illustration, without loss of generality, because they are the same for reception.

Referring to FIG. 2, a practical slot array comprises a flat plate 16 having its radiating elements 18 laid out in a somewhat different lattice arrangement than the idealized rectangular grid shown in FIG. 1. The same difficulties described in reference to the antenna of FIG. 1 apply equally to the design of FIG. 2. One possibility for the design of a baffle arrangement which images slots in such a way as to reduce the effects of mutual coupling variations between sum and difference excitations comprises a plurality of spaced baffles 20, arranged in a staggered manner in the plane perpendicular to the E-field. This technique is found to be effective but unnecessarily complex. The use of a straight baffle as shown in FIG. 1 is found to provide the desired result.

Figure 3:
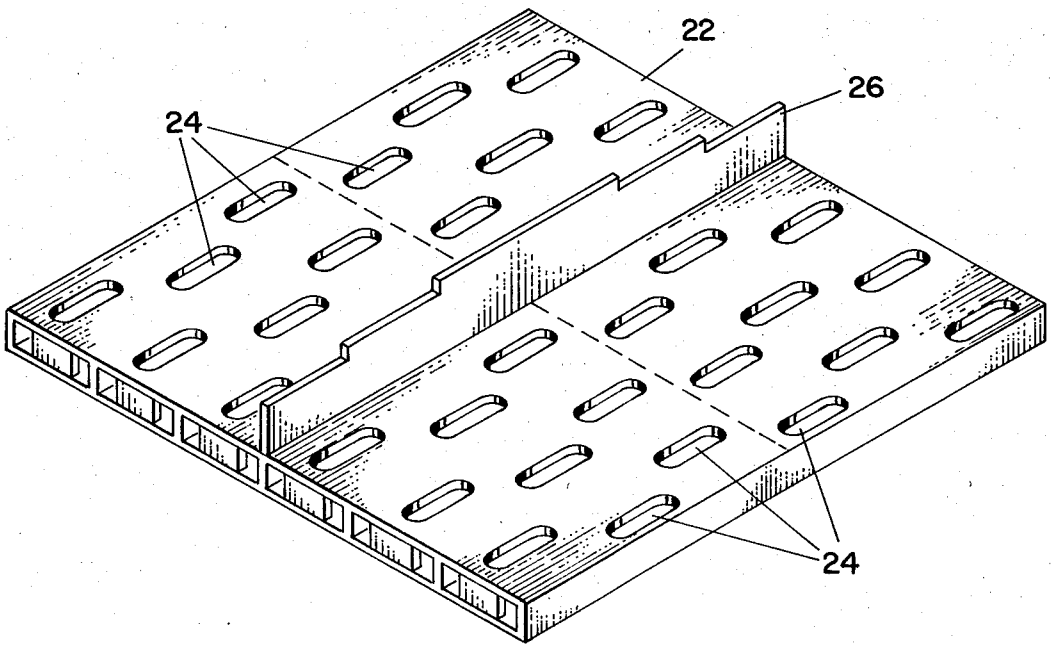
FIG. 3 is a perspective view of yet another embodiment.

Even with the presence of a finite baffle as shown in FIG. 2 there is a residual amount of mutual coupling between the functional halves of the aperture (A+B) and (C+D). Over a very wide frequency band variations in this coupled signal causes undesirable fluctuations in the sensitivity of the monopulse antenna. This problem is overcome by the embodiment shown in FIG. 3. In FIG. 3 there is shown the plate 22 with slots 24 and a stepped baffle 26 used in place of the straight baffle of FIG. 1. The effect is much the same as a stagger—tuned or multiple element filter which minimizes the ripple over the operating band. In this manner the fluctuations in sensitivity and difference pattern peak levels over frequency are reduced by a factor of more than 2 (or 3) to 1 relative to conventional arrays.

Any of the baffle arrangements of FIGS. 1, 2, or 3 represents an embodiment of the basic invention. Specific improvements of the invention include:

(1) that the difference pattern peak level is higher than obtainable with conventional antennas and (2) that the difference pattern sidelobe level is significantly lower than obtainable with conventional antennas.

The baffle as described herein must be of a height of at least about one-quarter of a wave length to get sufficient results. It can be of any height to obtain some effect but at least one-quarter wave length to obtain results with sufficient effect to be of real use. The baffle can also be of infinite height and in fact, theoretically, infinite height gives the maximum effect, however, for practical purposes at height of over one-half wave length there is a diminishing return.

Figure 4:
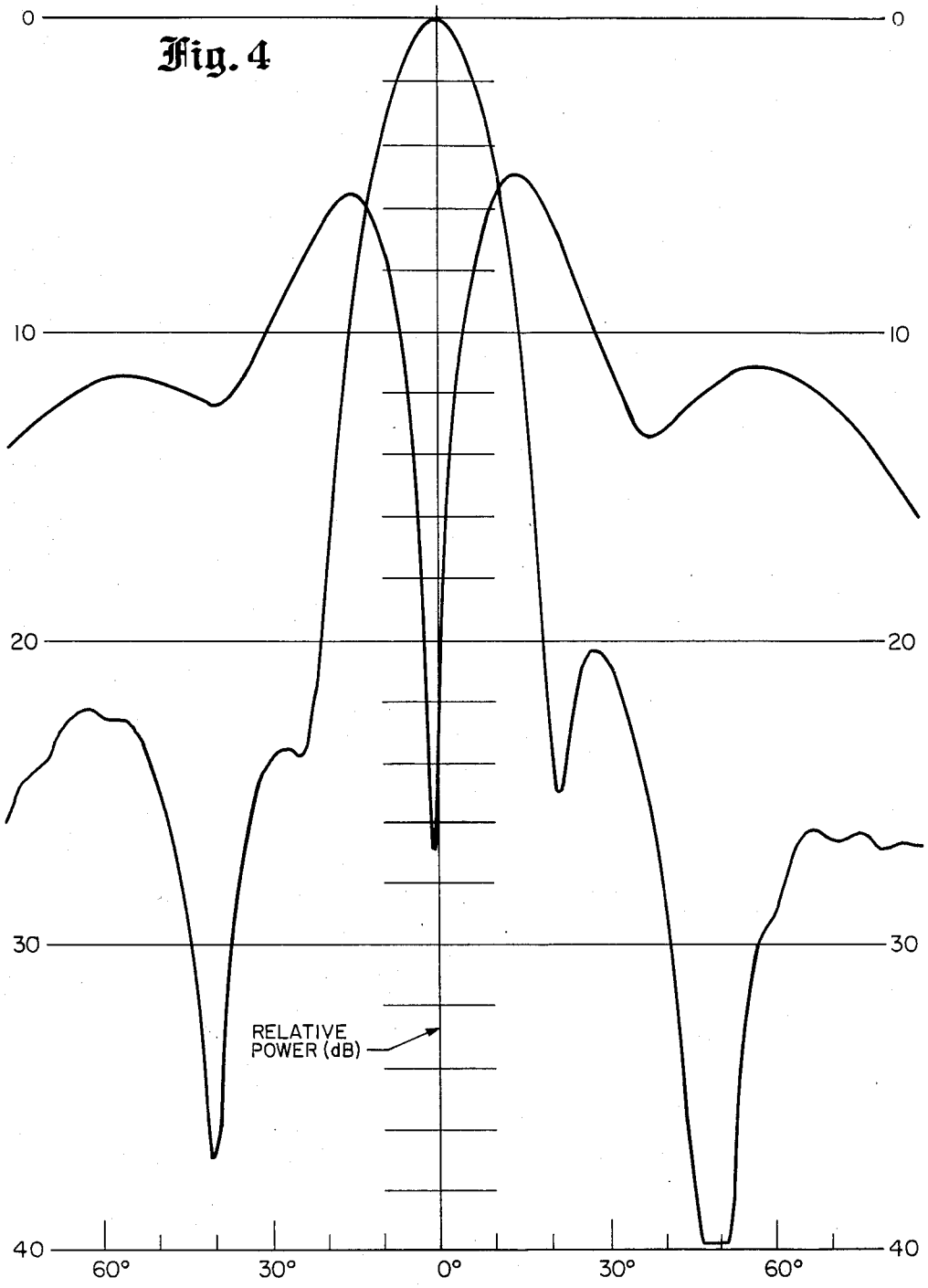
FIG. 4 is a graph of a standard antenna.
Figure 5:
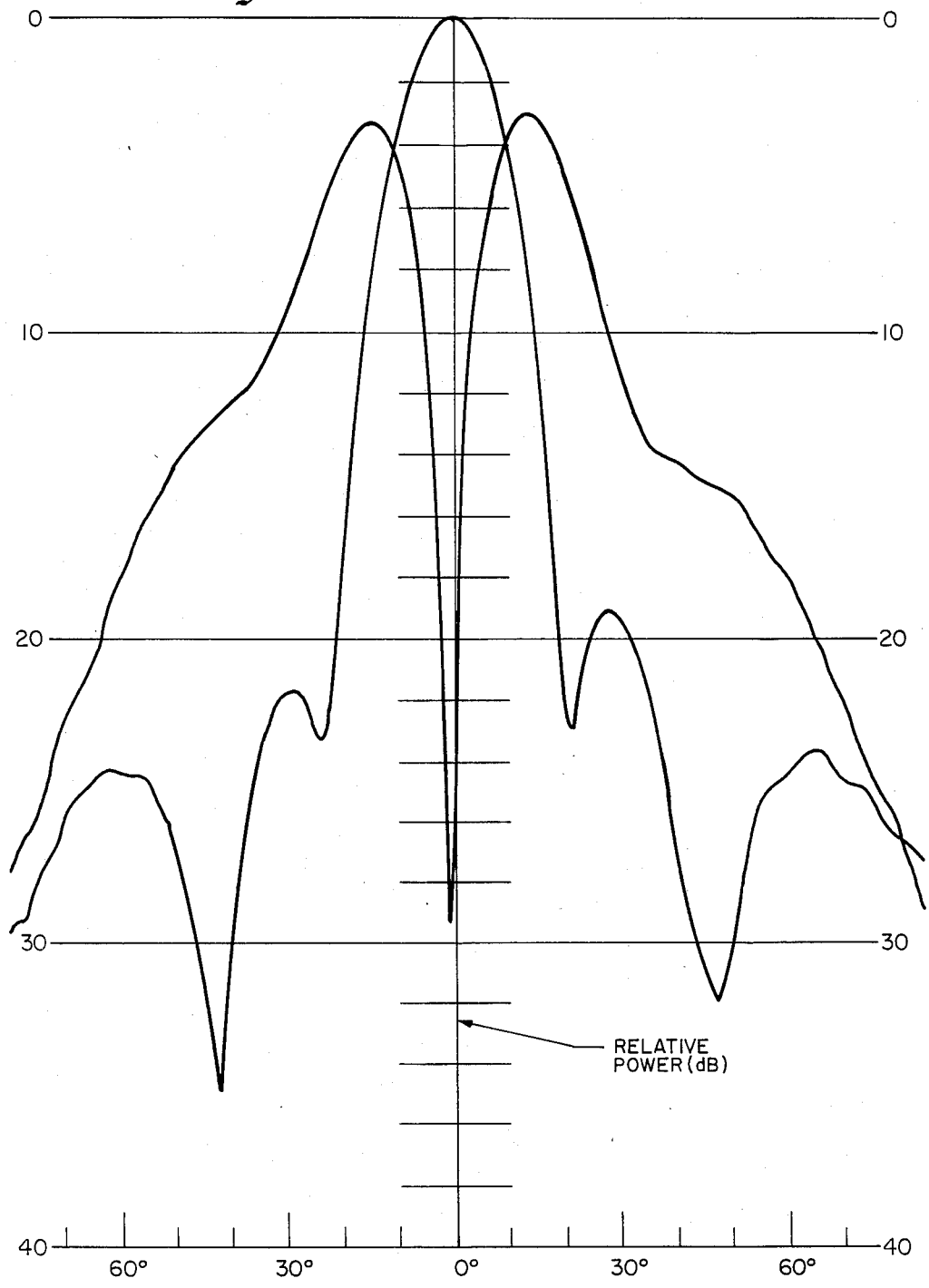
FIG. 5 is a graph using the baffle of this invention.

Tests were conducted on an antenna as described in FIG. 1 with a baffle as described in FIG. 1. The baffle had a height of one-half wave length. The results and benefits are shown in a comparison of the two graphs shown in FIG. 4 and FIG. 5. It can be seen that with the baffle device the sum pattern is unchanged, the difference pattern peak level is improved and the sidelobe interference is greatly reduced.

Having described the invention it is desired that it be limited only by the scope of the appended claim:

We claim:

1. A waveguide slot antenna consisting of four quadrants A, B, C and D which create two functional halves (A+B) and (C+D) comprising a flat plate, said plate containing a plurality of radiating slots, said slots having longitudinal and transverse axes and arranged in a lattice, a baffle interposed between the two functional halves of the plate (A+B) and (C+D) in a plane (perpendicular) parallel to the (E-field) longitudinal axes of the (plate) slots.

2. The device of claim 1 wherein the baffle is between one-quarter to one-half wave length in height.

3. The device of claim 1 wherein the baffle comprises a series of staggered baffles.

4. The device of claim 1 wherein the baffle is stepped in height.

* * * * *